US005529242A

United States Patent [19]

Hedin

[11] Patent Number: 5,529,242

[45] Date of Patent: Jun. 25, 1996

[54] DEVICE FOR MAKING SNOW

[76] Inventor: Fredrik Hedin, Opalvägen 3, S-269 41, Östra Karup, Sweden

[21] Appl. No.: 258,185

[22] Filed: Jun. 10, 1994

[30] Foreign Application Priority Data

Jun. 11, 1993 [SE] Sweden ..... 9302062

[51] Int. Cl.[6] ..... F25C 3/04

[52] U.S. Cl. ..... 239/14.2; 239/424; 239/521

[58] Field of Search ..... 239/2.2, 14.2, 239/416.4, 416.5, 432, 518, 520, 521, 523, 524, 423, 424

[56] References Cited

U.S. PATENT DOCUMENTS

| | | | |
|---|---|---|---|
| 2,591,188 | 4/1952 | Nilsson | 239/521 X |
| 2,676,471 | 4/1954 | Pierce, Jr. | 239/2.2 X |
| 3,120,261 | 2/1964 | Gonzalez | 239/523 X |
| 3,146,951 | 9/1964 | Brown | 239/14.2 |
| 3,494,559 | 2/1970 | Skinner | 239/2.2 |
| 3,761,020 | 9/1973 | Tropeano et al. | 239/2.2 |
| 3,814,319 | 6/1974 | Loomis | 239/2.2 X |
| 4,072,270 | 2/1978 | Harmony | 239/432 X |
| 4,610,760 | 9/1986 | Kirkpatrick et al. | 239/424 X |
| 5,090,619 | 2/1992 | Barthold et al. | 239/2.2 X |

FOREIGN PATENT DOCUMENTS

| | | | |
|---|---|---|---|
| 393318 | 9/1991 | Austria . | |
| 913205 | 2/1993 | Norway . | |
| 529325 | 10/1972 | Switzerland . | |
| 1540866 | 2/1990 | U.S.S.R. | 239/424 |

*Primary Examiner*—Kevin P. Weldon

[57] ABSTRACT

A method and apparatus for continuously making and distributing snow. The apparatus includes a first and second tube through which compressed air and water are flowed. The tubes have outlet portions where the water and air impinge on a cup shape nozzle head. The air and water are flowed at a substaintially constant pressure but the decompressed air has a greater velocity at the outlet portion than the water to aid in cooling. The water impinges on the atomizing surface of the nozzle head to produce small droplets which in the ambient creates snow for example for skiing.

7 Claims, 1 Drawing Sheet

DEVICE FOR MAKING SNOW

BACKGROUND OF THE INVENTION

The present invention relates to a method for continuously making and distributing snow or small water droplets, and to a device for carrying out the method.

Downhill skiing is practised by a large number of people all over the world, both by amateurs and by professionals. Downhill disciplines generally require a ground covered by snow and/or ice. However, since the access to snow is highly varying, depending e.g. on the season, the weather etc, attempts have been made to produce artificial snow or ice as a substitute.

Thus, many downhill facilities are equipped with snow guns, i.e. devices for making and distributing snow, or more specifically small water droplets, which in the ambient cold atmosphere freeze into ice crystals. Many such devices are known, all of which operate according to substantially the same principle. According to this principle, a water jet and an air jet are mixed and the mixture is broken up into smaller droplets which on their way to the ground freeze into ice crystals.

The most basic technique for making ice crystals appears to be described in U.S. Pat. No. 2,676,471. In a device disclosed in this publication, water and air are mixed in a plurality of nozzles mounted e.g. on a sled, whereupon the mixture is squeezed out under high pressure through small nozzle orifices and is thus distributed over the piste. Mixture takes place in a chamber located in the front part of the nozzle, the air being caused when passing into the chamber to entrain water fed to an annular gap in the chamber. To form small droplets in the water-air mixture, the chamber has a convex surface on which the entering jet impinges.

For instance, to improve the distribution of the droplets thus formed and to increase efficiency, it is known from U.S. Pat. No. 3,814,319 to mount a device of the type described in U.S. Pat. No. 2,676,471 in the top of a mast having a length of at least 3 m (10 feet).

The device described in CH-PS-529,325 operates substantially according to conventional principles. The device comprises a chamber in the form of a tube, in which water and air are mixed. This mixture is then fed to a nozzle containing a ball which atomizes the mixture before this leaves the nozzle through holes or channels provided therein.

The device known from NO-L-913,205 comprises a chamber for mixing water and air. Moreover, there is provided a means for maintaining a substantially constant pressure in the mixing chamber.

A currently extensively used type of snow gun is the low-pressure snow gun. This type of gun is described in AT-B-393,318 and is based on the principle of using a powerful fan for accelerating and distributing the water-air mixture. As opposed to the above-mentioned devices, which operate according to the high-pressure principle, the water is sprayed into the air stream produced by the fan, thus mixing the water and the air in the fan-induced air stream, and not in a mixing chamber. One advantage of this type of snow gun is that it is considerably more silent in operation than snow guns of the high-pressure type.

Even if the prior-art devices perform satisfactorily in respect of snow making, they suffer from certain drawbacks, of which only some are mentioned here. One of the more serious drawbacks is the high power consumption (kWh/m$^3$) in connection with snow making.

Another drawback is that, owing to limited efficiency and distributing capacity, a relatively large number of devices are normally required for covering e.g. a piste for downhill skiing.

Moreover, the nozzles of both the high-pressure and the low-pressure type are liable to icing, which often results in clogging of the nozzles. Thus, these devices must be constantly attended to, which requires much labour.

SUMMARY OF THE INVENTION

One object of the present invention is to provide a device for continuously making and distributing snow or small water droplets which overcomes the above-mentioned drawbacks.

Another object of the invention is to provide a device having increased capacity per unit of time for making and distributing snow as compared with the prior art.

Also, the device according to the invention should satisfy the same requirements as do known snow guns of the high-pressure type, i.e. should be connectible to existing pipes for supply of water and compressed air. Furthermore, the inventive device should be substantially maintenance-free and permit mounting over ground level.

According to the invention, these objects are achieved by means of a device for continuously making and distributing snow or small water droplets to an ambient atmosphere.

DESCRIPTION OF THE PREFERRED EMBODIMENT

Figure 1:
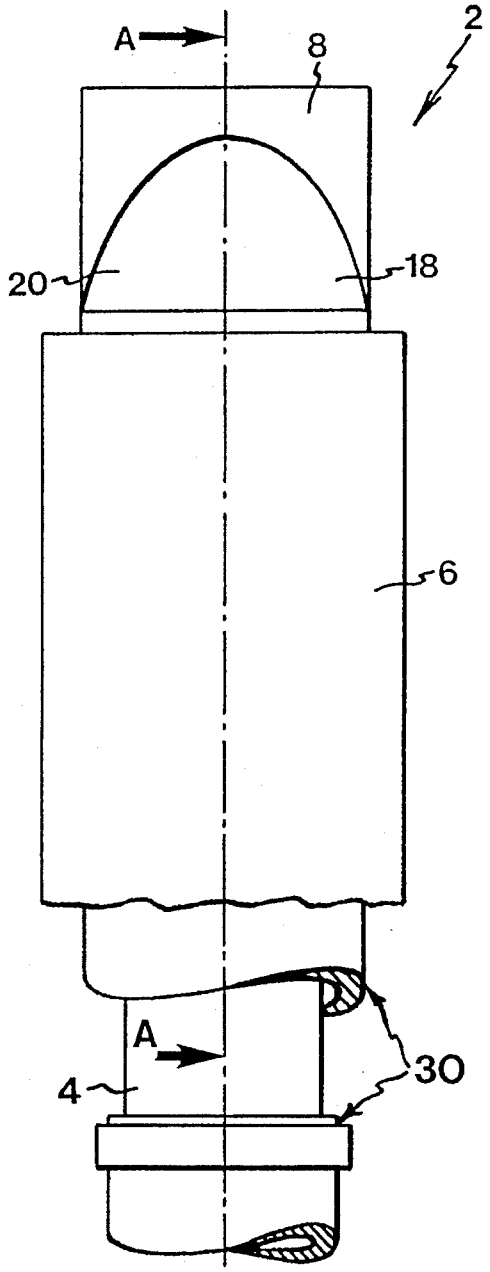
FIG. 1 is a front view of the inventive device, in which a snow-distributing nozzle orifice is clearly visible.

Reference is now made to the drawing illustrating a currently preferred embodiment of an inventive device 2 for making and distributing snow or small water droplets. The device 2 comprises a first channel in the form of an inner tube 4 and a second channel in the form of an outer tube 6. In the illustrated embodiment, the outer tube 6 is integrated with an obstacle in the form of a nozzle head 8. It is however understood that the nozzle head may also consist of a separate unit connected, for example, to the aforementioned outer tube.

Figure 2:
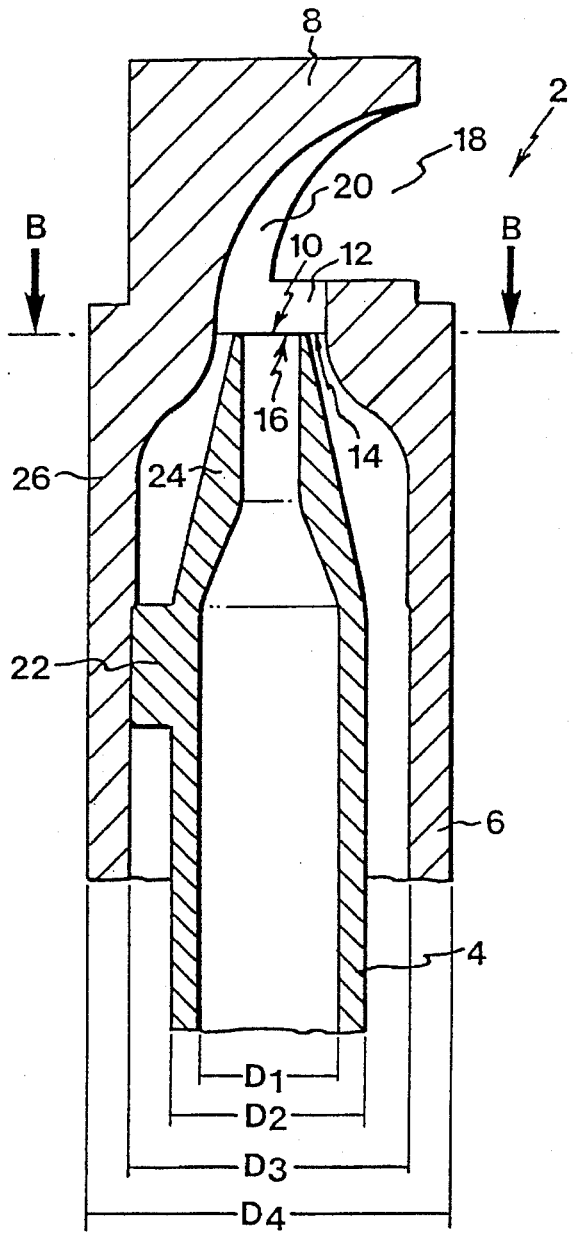
FIG. 2 is a sectional view of the inventive device taken along line A—A in FIG. 1.

The nozzle head 8 has a feed opening 10 which faces and communicates, e.g. via a channel 12, with an opening 14 in the outer tube 6 and with an opening 16 in the inner tube 4. A nozzle orifice 18 is arranged in the nozzle head 8 for distributing the water droplets produced by means of the device 2 and forming the snow or the ice crystals sprayed on to the ground. Between the nozzle orifice 18 and the feed opening 10, there is formed a distributing and atomizing surface 20. As illustrated in FIG. 2, the feed opening 10 and the nozzle orifice 18 are located in different planes making an angle with each other. In the illustrated embodiment, this angle is substantially 90°. It is however understood that the angle may be greater or smaller. The resultant angular distance, here being 90°, is thus bridged by the distributing and atomizing surface 20 provided in the nozzle head 8. From the functional description below it becomes apparent that the distributing or spreading sector of the device depends, among other things, on the design of the nozzle orifice 18 and the distributing and atomizing surface 20. In the illustrated embodiment of the present invention, this surface is concavely curved or cup-shaped. It is however also possible to provide a flat, oblique surface, although this adversely affects the spreading capacity.

From the sectional view of the device 2 in FIG. 2 appears especially clearly the shape of the inner surface of both the inner tube 4 and the outer tube 6. It is clearly seen that the inner tube 4 according to the preferred embodiment of the invention is located within and is surrounded in spaced-apart relationship by the outer tube 6. The special advantage of this design will be explained further on. The inner tube 4 consists of a tubular element, here having circular cross-section. It thus has an inner diameter $D_1$ and an outer diameter $D_2$, $D_1<D_2$. It is however understood that the inner tube may also have another cross-sectional shape. For reasons given below, the inner diameter $D_1$ decreases in the direction of the end of the inner tube 4 having the opening 16. This diameter reduction preferably takes place continuously by means of a bead 24, here annular, which is provided on the inside of the inner tube 4.

The outer tube 6, surrounding the inner tube 4 in spaced-apart relationship, also consists of a tubular element, here having circular cross-section. It thus has an inner diameter $D_3$ and an outer diameter $D_4$, $D_2<D_3<D_4$. It is understood that the outer tube may also have another cross-sectional shape. For reasons given below, the inner diameter $D_3$ decreases in the direction of the end of the outer tube 6 having the opening 14. The diameter reduction preferably takes place continuously by means of a bead 26, here annular, which is provided on the inside of the outer tube 6. In the embodiment illustrated in the Figures, the outer diameter $D_2$ of the inner tube 4 also decreases in the vicinity of the end facing the nozzle head 8, which is compensated for by a corresponding shape of the bead 26 of the outer tube 6. Between the inner tube 4 and the outer tube 6 are provided spacer means 22 (see FIG. 2) fixing the inner tube 4 and the outer tube 6 in relation to each other without obstructing the flow through the interior of the outer tube 6.

Figure 3:
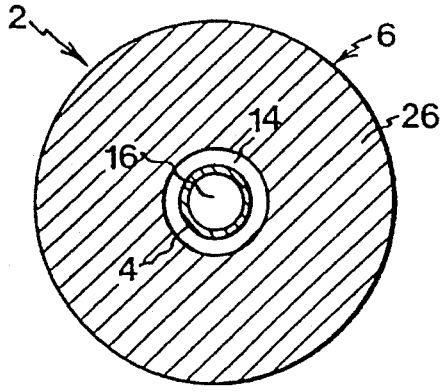
FIG. 3 is a sectional view of the inventive device taken along line B—B in FIG. 2.

The ends, remote from the nozzle head 8, of the inner tube 4 and of the outer tube 6 are connected to supply means in the form of conduit systems 30 for water and compressed air, respectively. In the currently preferred embodiment of the invention, the inner tube 4 is connected to the water conduit system, and the outer tube 6 is connected to the corresponding compressed-air system. The reason why the water is discharged through the opening 16, here being circular, and the air is discharged through the opening 14, here being annular, see especially FIG. 3, will appear from the following functional description.

After the device 2, i.e. the inner tube 4 and the outer tube 6, has been connected to the existing conduit systems for water and compressed air and the respective pump and compressor have been actuated, water is supplied, in the embodiment here described, to the inner tube 4 of the device 2 and compressed air to the outer tube 6, the compressed air thus enveloping the exterior surface of the inner tube 4 and, on its way to the annular opening 14, passing the spacer means 22 provided between the inner tube and the outer tube. At a substantially constant water pressure, the diameter reduction, i.e. the bead 24 in the inner tube 4, entails an increase of the flow velocity $V_w$ of the water. The same applies to the flow velocity $V_a$ of the compressed air, which increases considerably when the air is passing the bead 26 of the outer tube, at a substantially constant air pressure. To achieve the desired cooling effect, the flow velocity $V_a$ of the air should, when the air is passing through the annular opening 14, be considerably higher than the flow velocity $V_w$ of the water when this is passing through the opening 16, i.e. $V_a>>V_w$.

The water is discharged through the opening 16 into the ambient atmosphere, the water being surrounded by an air stream which has high velocity and good cooling capacity, and which envelops the water in a casing- or shell-like fashion. At the same time as the air is cooling the water, the water jet discharged through the opening 16 is disrupted into smaller droplets which are accelerated on their way to the distributing and atomizing surface 20 of the nozzle head 8 located in the ambient atmosphere. These small water droplets impinge at high velocity on the curved distributing and atomizing surface 20, against which they are broken up into extremely small droplets having a diameter of about 0.3 mm, while the flow direction is changed towards the nozzle orifice 18. Also the flow direction of the compressed air is changed, the air and the aforementioned small water droplets together passing out through the nozzle orifice 18, this assisting in spreading the droplets over a considerable area. On their way to the ground, these small droplets freeze into ice crystals and thus form snow covering the ground. For covering a large area, it is preferred to mount the device at the top of the ski-lift system, in lighting masts and the like. An advantage in this context is that skiing can proceed also during the distribution of "artificial" snow.

There is thus provided a device for continuously making and distributing snow or small water droplets, in which the provision of a distributing and atomizing surface located in the atmosphere contributes to giving the device high capacity in the production and distribution of snow or small water droplets. Practical tests at −6° C. have shown that the total energy consumption ($kWh/m^3$) for making and distributing a certain amount of snow only is about 30–50% of the corresponding energy consumption in prior-art devices. Besides, the problem of ice-clogging is overcome in the inventive device by the distributing and atomizing surface being disposed in the atmosphere, given that the water freezes when discharged into the atmosphere.

Obviously, it is possible to depart somewhat from the embodiment now described. Thus, it is possible to provide the distributing and atomizing surface in a separate unit which is spaced from the discharge openings of the water and air channels. All variants and modifications comprised by the inventive concept should however be considered to be encompassed by the appended claims.

What I claim and desire to secure by Letters Patent is:

1. A device for continuously making and distributing snow or small water droplets to an ambient atmosphere, comprising, a first elongate channel formed by an inner tube having an outlet portion with an opening, which provides for conducting liquid;

a second elongate channel formed by an outer tube which provides for conducting air located around said first elongate channel having an outlet portion with an opening, said outlet portion being located adjacent and extending along the outlet portion of the said first channel;

the outer tube longitudinally encloses the inner tube and is radially spaced therefrom, the outlet portion of the inner tube being substantially centered within the outlet portion of the outer tube, so that the air surrounds the liquid at the openings of said outlet portions;

means for supplying liquid and air to said first and said second channel, respectively, so that the liquid and the air pass through said channels in a substantially same direction of flow, via their respective outlet portions and out through the openings of their respective channels; and an obstacle forming a nozzle head fixedly connected to said second channel, having a distributing and atomizing surface which is located in the atmosphere in the direction of flow of the liquid and the air, in spaced-apart relationship to the openings of said first and second channels, for distributing and atomizing the liquid and the air passing via the respective outlet portions out through the respective openings, the distributing and atomizing surface making an angle with the direction of flow of the air and the liquid;

wherein the distributing and atomizing surface is cup-shaped.

2. A device as claimed in claim 1, wherein there is provided a constriction in both the outer and the inner tube for increasing the flow velocity of the air and of the liquid.

3. A device as claimed in claim 2, wherein the nozzle head has a feed opening communicating with the opening of the respective tube, and a nozzle orifice which via the distributing and atomizing surface communicates with the feed opening, and wherein the feed opening and the nozzle orifice are located in different planes making an angle with each other.

4. A device for continuously making and distributing snow or small water droplets to an ambient atmosphere, comprising, a first elongate channel formed by an inner tube having an outlet portion with an opening;

a second elongate channel formed by an outer tube located around said first elongate channel having an outlet portion with an opening, said outlet portion being located adjacent and extending along the outlet portion of the said first channel;

one of said first and second channels for conducting liquid and the other for conducting air;

means for supplying liquid and air to said first and said second channel, respectively, so that the liquid and the air pass through said channels in a substantially same direction of flow, via their respective outlet portions and out through the opening of their respective channels; and an obstacle forming a nozzle head attached to said second channel, having a distributing and atomizing surface which is located in the atmosphere in the direction of flow of the liquid and the air, in spaced-apart relationship to the openings of said first and second channels, for distributing and atomizing the liquid and the air passing via the respective outlet portion out through the respective opening, the distributing and atomizing surface making an angle with the direction of flow of the air and the liquid;

wherein the inner and outer tubes each has a first end and a second end which includes said outlet portions, with an inner diameter of the first tube and the second tube being greater at the first end than a corresponding diameter of the first tube and the second tube at their respective second ends.

5. The device as claimed in claim 4, wherein the distributing and atomizing surface is cup-shaped.

6. The device as claimed in claim 5, wherein the means for supplying air supplies compressed air through the outer tube at a substantially constant pressure and emits said compressed air through the outer tubes outlet opening at a first velocity and, the means for liquid supplies water through the inner tube at a substantially constant pressure and emits said water through the inner tube outlet opening at a second velocity which is less than said first velocity, so that said compressed air performs a desired cooling effect.

7. The device as claimed in claim 6, wherein said diameters change smoothly from said first end towards said second end.

* * * * *